US005233789A

United States Patent [19]

Priest et al.

[11] Patent Number: 5,233,789

[45] Date of Patent: Aug. 10, 1993

[54] ADJUSTABLE CABLE GUIDE ASSEMBLY FOR POWERED SLIDING VEHICLE DOOR CLOSER

[75] Inventors: William L. Priest, Sterling Heights; Ian Martin, Pontiac, both of Mich.

[73] Assignee: General Motors Corporation, Detroit, Mich.

[21] Appl. No.: 975,333

[22] Filed: Nov. 16, 1992

[51] Int. Cl.[5] ..... E05F 11/00

[52] U.S. Cl. ..... 49/360

[58] Field of Search ..... 49/360, 280

[56] References Cited

U.S. PATENT DOCUMENTS 4,984,385 1/1991 Deland ..... 49/360 X 5,046,283 9/1991 Compeau et al. ..... 49/138

*Primary Examiner*—Philip C. Kannan

*Attorney, Agent, or Firm*—Charles E. Leahy

[57] ABSTRACT

A vehicle access door is operatively mounted for powered fore and aft sliding movement between open and closed positions. A power module disposed internally of the vehicle has motor driven cable reels mounted on a space frame having door pull cables wound thereon routed by forward and rear cable guide assemblies into operative connection with the access door. The rear cable guide assembly is an adjustable two part guide pulley assembly in which a first housing part is adjustably carried by the space frame and the second housing part is adjustably mounted on the first housing part so that the assembly can be subsequently fitted and attached to production vehicles having a wide build tolerance in the support structure for the module and the rear cable guide assembly. The adjustment provided by the rear cable guide assembly assures high quality fits with good sealing of the pull cable access opening and positions the pull cable in an external guide channel to eliminate frictional wear between these components.

6 Claims, 3 Drawing Sheets

ADJUSTABLE CABLE GUIDE ASSEMBLY FOR POWERED SLIDING VEHICLE DOOR CLOSER

FIELD OF THE INVENTION

This invention relates to powered sliding doors for vehicles, and more particularly, to a new and improved cable guide assembly for accommodating tolerances in quantity production vehicles while providing high quality fits and for positioning a door pull cable in a guide channel to prevent frictional contact and wear therebetween.

BACKGROUND OF THE INVENTION

Vans and various other automotive vehicles have utilized access doors which slide fore and aft in tracks between open and closed positions. An illustrative vehicle with a powered sliding access door is disclosed in U.S. Pat. No. 5,046,283, issued Sep. 10, 1991 to David E. Compeau et al., assigned to the assignee of this invention and hereby incorporated by reference.

SUMMARY OF THE PRESENT INVENTION

The power sliding door closer and cable guide assembly of this invention is of the general category of that of the above cited U.S. patent and has a power module for the moving the door between open and closed positions. This invention is more particularly drawn to a new and improved rear pull cable guide assembly that can be part of a power module which provides an adjustment that allows the module and the cable guide assembly to be closely fitted to vehicles having a wide tolerance in the body work to which the power module and cable guide assembly is mounted. With this invention, the pull cable is positioned in a cable guide track without physical contact therebetween to prevent or reduce cable wear and increase cable service life. With this invention a high quality fit of the module and the fit of the rear cable guide assembly with a vehicle is assured since the assembly is adaptable to fit a wide variance in module and cable guide mountings occurring in quantity production vehicles.

This invention provides a new and improved module having a cable guide assembly supported thereon that can be affixed to support structure within a vehicle and adjusted so that the cable will be positioned in an associated guide track with suitable clearances to prevent cable wear and to thereby extend cable service life.

More particularly, the adjustable cable guide assembly is a two part horizontal and vertical housing assembly that is designed to provide efficient routing of a door pull cable through vehicle body structure. The assembly is designed to adjust to build variation occurring from vehicle to vehicle To minimize frictional losses in the guide assembly, cable routing pulleys are advantageously employed. One pulley in each housing part or half of the assembly reduces friction from the door pull cable system and large lead angles provided by the pulleys aid in reducing the effects of misalignment of the structural components of the vehicle body. The two housing parts of the assembly have a sliding adjustment therebetween with a set screw used for adjusting and securing the two parts in a relative fixed position. A conical cable guide and locater of the horizontal housing part of the assembly is readily positioned in a circular access hole or opening in the outer body panel and has a cable guide opening that provides a cleaning and sealing action on the pull cable while the external surface thereof contacts and seals the access hole. Once the horizontal or transverse housing part of the assembly has been positioned in the access hole, the vertical housing can then be positioned against the inner body panel and fastened thereto.

It is a feature, object and advantage of this invention to provide a new and improved cable guide assembly for guiding a pull cable of a slidable door which has a first pulley housing unit mounted generally vertically on a support for guiding a door pull cable thereacross, and which has a second pulley housing unit adjustably mounted transversely with respect to the first housing unit so that the cable can be guided therefrom into a position in an associated cable guide channel whereby the cable is clear of frictional contact with the channel to thereby allow the cable to operate without undue friction and wear therebetween so that service life of the cable and the cable guide is optimized.

These and other features, object and advantages of this invention will become more apparent from the following detailed description and drawing in which:

DETAILED DESCRIPTION OF THE DRAWINGS

Figure 1:
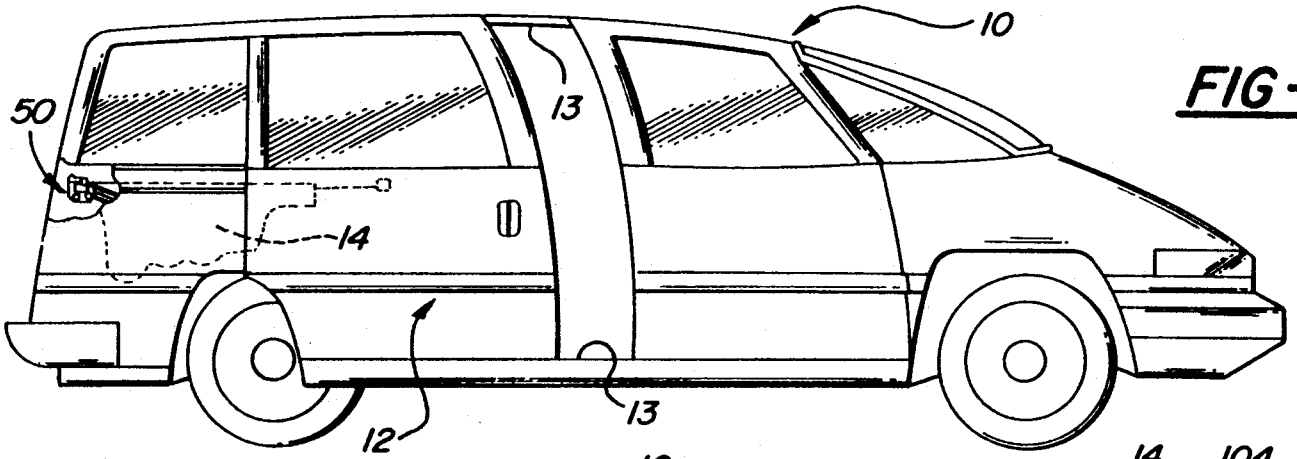
FIG. 1 is a side elevational view, broken away in part, of an automotive vehicle with a powered sliding rear side door.
Figure 2:
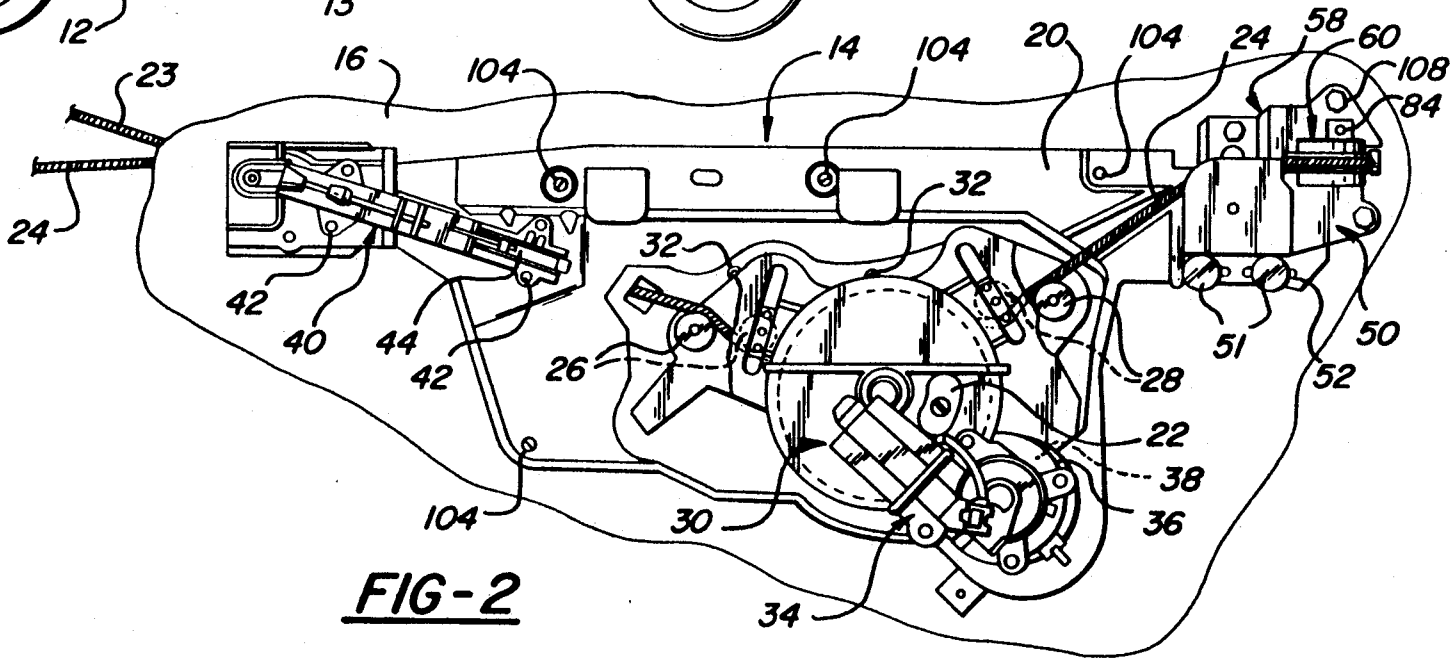
FIG. 2 is a side elevational view of an interior portion of the vehicle of FIG. 1 showing a power module for moving the side door between open and closed position.

Turning now in greater detail to the drawing, there is shown in FIG. 1 an automotive vehicle 10 having a slidable access door 12 on one side thereof. This door has conventional upper and lower arms with rollers that run in upper and lower guide channels or tracks 13 in the vehicle so that the door can be moved between fore and aft, closed and opened positions for occupant entrance and egress as disclosed in the above referenced U.S. Pat. No. 5,046,283. In the preferred embodiment of the present invention, the door is powered to move between these positions by actuation of a power module 14 mounted to an interior side support panel 16 within the vehicle.

The power module and various components thereof are described in co-pending applications Ser. Nos. 08/008816, 08/008817, 08/008905, 08/008907, all filed Jan. 25, 1993 and assigned to the assignee of this invention and hereby incorporated by reference. In basic organization, this module has a space frame 20 formed from plastics, sheet metal, or other suitable material, with offset areas that support a powered double reel 22 for pull cables 23, 24, respectively, and associated cable idler pulleys 26, 28 operatively mounted within a housing 30 secured to the space frame 20 by threaded fasteners 32. A reversible drive motor 34 is selectively energizable to rotatably drive a transfer gear unit 38 mounted in housing 36 that is secured to the housing 30. The teeth of the transfer gear mesh with the teeth of a gear integral with the double reel 22 so that it can be rotatably driven in clockwise or counterclockwise directions to wind one cable on one reel and unwind the other cable on the other reel to open and close the access door in accordance with selected operation of door controls, not shown.

In addition to the cable reel, pulleys, drive motor, transfer gear and housing, the power module 14 has a front cable guide assembly 40 attached by threaded fasteners 42 to the space frame 20 which has pulleys, such as pulley 44, operatively mounted therein to guide the door pull cable 23 from its attachment with the door 12 to the reel 22.

To guide and route door pull cable 24 leading from the reel 22 and idler pulleys 28 through the spaced inner and outer side panels 16 and 49 of the vehicle, the present invention is drawn to a rear cable guide assembly 50 which is loosely secured to the space frame by suitable fasteners 51 such as those of the "Christmas tree" type. Such fasteners are formed from plastics and have elongated shanks with resilient retainer fins thereon. When installed, these shanks extend through elongated adjustment slots 52 in a lower flange 53 of a first idler pulley unit of the rear cable guide assembly and space frame annular openings 56 causing deflection of the fins which subsequently recover on the outboard side of the space frame to loosely retain the guide assembly 50 to the space frame so that it can be subsequently adjusted and securely attached in the adjusted position to the inner side panel 16 of a production vehicle exemplified by vehicle 10.

This adjustment is needed because of allowable build variation such as in inner and outer panel spacing and in size and mounting locations for accommodating parts such as the rear cable guide assembly that normally occur in quantity production. Accordingly, the openings for the guide assembly 50 as well as the spacing of panels 16, 49 may vary from vehicle to vehicle and be within manufacturing tolerances.

Figure 6:
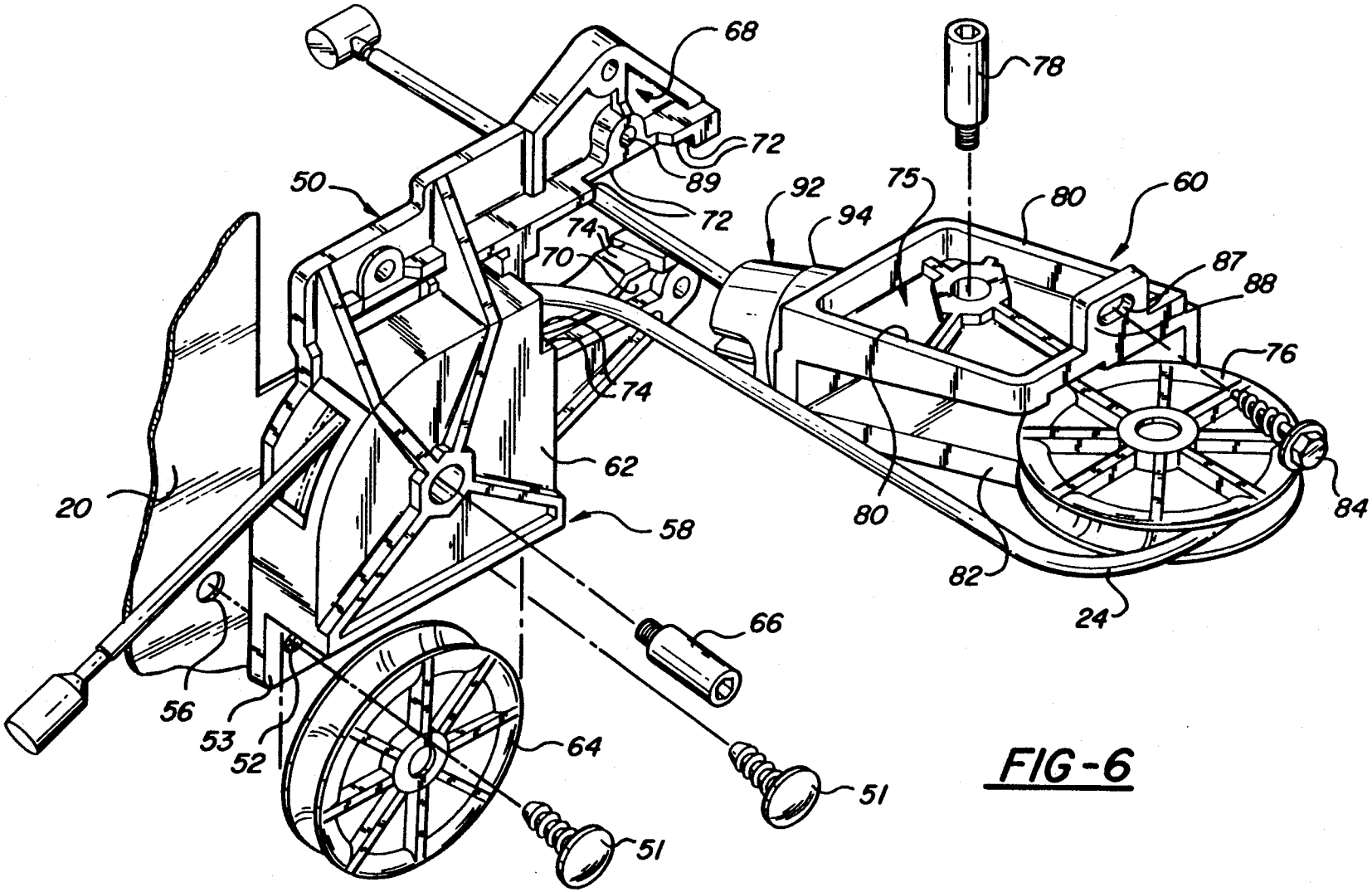
FIG. 6 is an exploded view of the rear cable guide assembly of the power door sliding module of FIGS. 2–5.

The rear cable guide assembly 50 of this invention has two housing parts or idler pulley units 58 and 60 which adjustably interfit with one another to compensate for such tolerance. The first pulley unit 58 is preferably formed as an injection molded body of engineering plastics material having a shell 62, integral with the lower flange 53, in which a cable pulley wheel 64 is housed. Pulley wheel 64 is rotatably mounted for rotation in a generally vertical plane on an axle provided by a cylindrical pin 66. This pin has a hex opening in its outermost end and a threaded inner end for threaded attachment into an inner wall of the shell 62. As shown in FIG. 6, the pulley wheel 64 can be inserted in an opening formed in the bottom of the shell 62, and after the pin openings in the shell 62 and the hub of pulley wheel are aligned, the pin is inserted and turned until the threaded end thereof is secured to the inner wall of the shell so that the pulley wheel is rotatably mounted therein.

Figure 3:
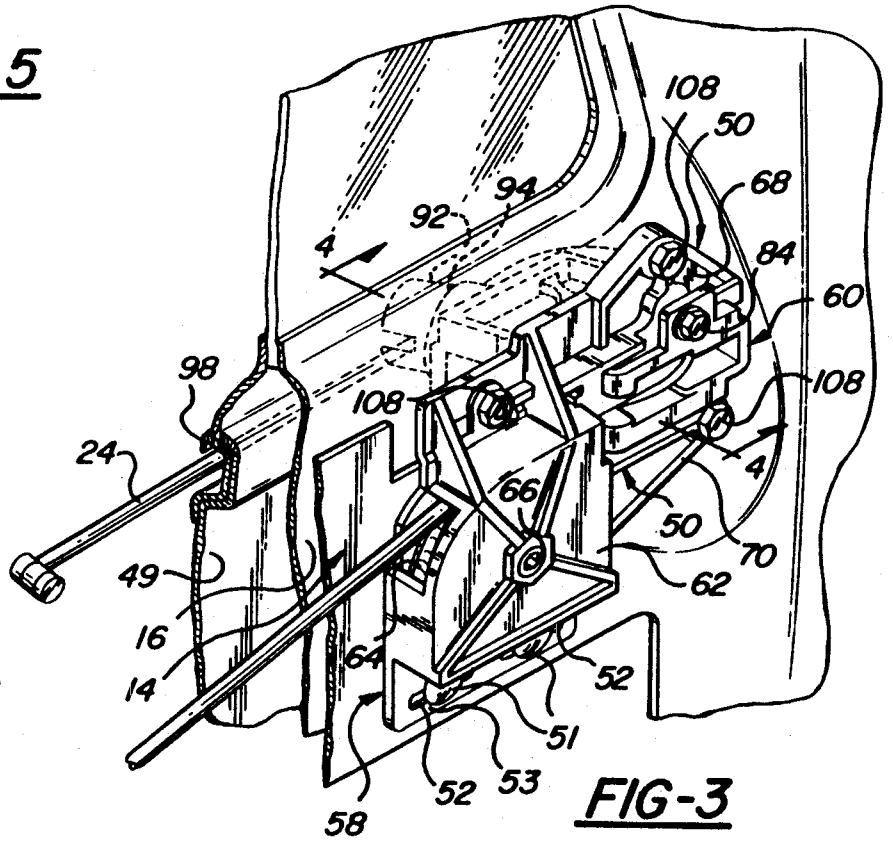
FIG. 3 is a pictorial view of a portion of the door sliding power module of FIG. 1 connected to an inner panel of the vehicle and illustrating details of a rear cable guide assembly.
Figure 5:
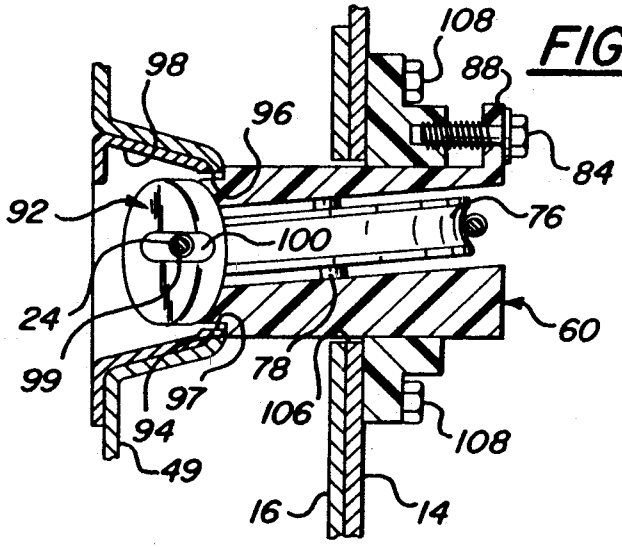
FIG. 5 is a view partly in section taken generally along sight lines 5—5 of FIG. 4.
Figure 4:
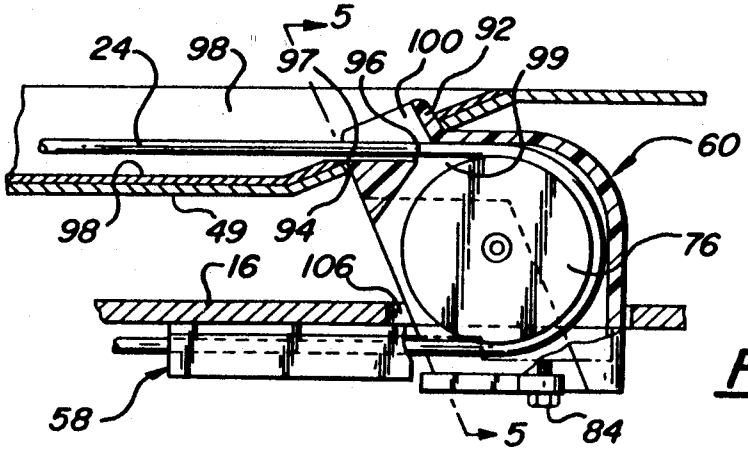
FIG. 4 is a top view of the rear cable guide assembly as installed with the module in a vehicle taken generally along sight lines 4–4 of FIG. 3.

In addition to the shell 62 and lower flange 53, the first housing part or pulley unit 58 has laterally extending upper and lower guides 68 and 70. These guides are vertically spaced from one another to define a bight therebetween and are formed with guide surfaces 72, 74 thereon to slidably receive the second housing part or idler pulley unit 60 of engineering plastics material that provides a shell or housing 75 for a pulley wheel 76 mounted for rotation in a plane transverse to that of pulley wheel 64 by a cylindrical pivot pin 78. This housing 75 has upper and lower walls 80 and 82 that slide on the guide surfaces 72, 74, respectively, of the first pulley unit so that the housing can be transversely adjusted through the bight of the first pulley unit. This adjustment is accomplished by turning of an adjusting screw 84 that extends through a slot 87 in an ear 88 extending upwardly from the shell of the second pulley unit into threaded connection with a opening 89 in the upper guide 68, as best shown in FIGS. 3, 4 and 5.

The second pulley unit 60 has a nose-like cable locater and guide 92 that is in the general form of a truncated cone which projects outwardly from a stepped annular stop shoulder 94. This cable locater and guide is adapted to fit within and seal circular access openings 96 and 97 formed in the outer panel 49 and the elongated and channeled cable guide track 98 fixed on the side panel 49 of the vehicle 10. The locater and guide 92 is formed with an annular cable feed opening 99 on a tangent line from pulley wheel 76 and a connected horizontal feel slot 100 therein. The opening and feed slot guide and position the cable 24 in a selected location with respect to the guide track 98. This opening and slot also serve to clean and seal the interior of the pulley housing as the cable winds therethrough. The outer surface of the guide 92 and in particular the shoulder 94 engage the inner surfaces of the panel 49 adjacent the access opening 96 to seal and prevent the entry of water and foreign matter into the space between the inner and outer panels 16 and 49.

In the event that the power module is secured to the inner panel 16 of the vehicle 10 by threaded fasteners 104 and the rear cable guide assembly does not align with the opening 106 in the inside panel, the "Christmas tree" fasteners 51 and the slots 52 provide a loose fit which allows the installer to laterally shift the rear cable guide assembly 50 until appropriate fit up is achieved.

Since the spacing of the inner an outer side panels 16 and 49 varies from vehicle to vehicle within allowable tolerance, the cable locater and guide 92 can be readily positioned by the installer by advancing or retracting the adjustment screw 84 so that shoulder 94 abuts the interior surface of the outer panel 49 defining the annular opening 96 to seal that opening and to center cable 24 in elongated cable guide track 98. Subsequently, threaded fasteners 108 are utilized to rigidly secure the idler pulley unit 58 to the inner panel of the vehicle.

As shown best in FIG. 5, the pulley wheel 76 and the cable guide 92 are inclined to improve the positioning of the cable in the guide track 49 of the vehicle 10. In other types of vehicles such orientations may not be needed and the pulley wheel can be on a truer vertical pivot.

While a preferred embodiment of the invention has been shown and described, other embodiments will now become apparent to those skilled in the art. Accordingly, this invention is not to be limited to that which is shown and described but by the following claims.

What is claimed is:

1. In a wheeled automotive vehicle having a body and an access door mounted for sliding movement along guide track means supporting said door between open and closed positions to provide vehicle entrance and egress, said vehicle having stationary support panel means, a power module assembly including a space frame adapted to be secured to said support panel, motor means and associated reel means secured to said space frame, cable means wound on said reel means and operatively connected to said door means for moving said door means between said open and closed positions, cable guide track means on the exterior of said vehicle, the improvement comprising a cable guide assembly located adjacent one end of the space frame, said cable guide assembly having a first support adjustably carried by said space frame and a cable support guide and housing means mounted for general transverse movement with respect to said first support, said cable support and guide housing means having pulley means therein for receiving said cable means, and cable locater and guide means for locating said cable support guide and housing means in a position with respect to said track means so that said cable is free from contact with said track means and means for adjusting and securing said cable support guide and housing means in a fixed position with respect to said first support.

2. An adjustable cable guide assembly for positioning and guiding a pull cable for a vehicle sliding door in a track for moving said door along an outer side panel of the vehicle, said cable guide assembly comprising first and second relatively adjustable supports having idler pulley means therein for operatively receiving said pull cable, said first support having guide surface means for receiving said second support for adjustable movement transverse with respect to said first support, said second support having a cable guiding nose means adapted to extend through an access opening in said outer side panel of said vehicle for guiding said cable in a path along the outer side of said vehicle.

3. The cable guide assembly of claim 3, wherein said guiding nose means fits into and seals said access opening.

4. The cable guide assembly of claim 3, and further including threaded adjustor means for adjusting said first and second supports relative to one another and for securing said supports in an adjusted position.

5. A guide assembly for routing and guiding a pull cable for a sliding closure for a vehicle, said closure being movable between opened and closed positions with respect to an opening in the vehicle, said guide assembly comprising a first housing having a cable routing and guide pulley operatively mounted therein for rotation in a first plane, a second housing associated with said first housing having a second routing and a guide pulley operatively mounted therein for rotation in a plane extending across said first plane and having cable guide means extending therefrom, and adjustment means for adjusting the relative position of said first and second housing so that said cable guide means can be selectively positioned at a fixed one of a plurality of positions to thereby establish the routing said pull cable.

6. The guide assembly of claim 5, wherein said second housing has a nose portion extending therefrom, said nose portion having a cable cleaning guide and feed opening therein disposed along a tangent extending from said guide pulley therein, support means extending laterally of said first pulley housing, guide track means formed in said support means, said second pulley housing being slidably mounted in said support means by said guide track means, and wherein said adjustment means comprises threaded means operatively interconnecting said second pulley housing and said support means of said first pulley housing so that said first and second housings can be relatively adjusted by turning said threaded adjuster means to advance and retract said threaded adjuster means with respect to said support means.

* * * * *